US006389860B1

(12) United States Patent
Stalzer

(10) Patent No.: US 6,389,860 B1
(45) Date of Patent: May 21, 2002

(54) CONTROL SYSTEM FOR A PRESS BRAKE

(75) Inventor: Leo Stalzer, Forsyth, MO (US)

(73) Assignee: Lion Machinery, Inc., Pacific, MO (US)

( * ) Notice: Subject to any disclaimer, the term of this patent is extended or adjusted under 35 U.S.C. 154(b) by 66 days.

(21) Appl. No.: 09/637,046

(22) Filed: Aug. 11, 2000

(51) Int. Cl.[7] ..... B21D 55/00

(52) U.S. Cl. ..... 72/1; 72/28.1; 72/389.6; 192/134

(58) Field of Search ..... 192/134, 132; 72/389.3, 389.6, 1, 48.1, 444

(56) References Cited

U.S. PATENT DOCUMENTS

| | | | | |
|---|---|---|---|---|
| 1,962,742 A | * | 6/1934 | Jonegedyk | 192/134 |
| 2,241,556 A | * | 5/1941 | MacMillin | 192/134 |
| 3,841,140 A | * | 10/1974 | Hryc | 72/21.2 |
| 4,166,369 A | | 9/1979 | Nakajima | |
| 4,308,734 A | | 1/1982 | Senft | |
| 4,357,820 A | | 11/1982 | Blanchard | |
| 4,489,578 A | * | 12/1984 | Nagai et al. | 72/21.1 |
| 4,660,703 A | | 4/1987 | Filcich et al. | |
| 4,772,801 A | | 9/1988 | Fornerod et al. | |
| 4,907,432 A | | 3/1990 | Maillefer | |
| 5,921,367 A | | 7/1999 | Kashioka et al. | |

* cited by examiner

*Primary Examiner*—David Jones
(74) *Attorney, Agent, or Firm*—Polster, Lieder, Woodruff & Lucchesi

(57) ABSTRACT

A press brake machine has a movable ram, a fixed bed, a drive for moving the ram toward and away from the bed, and a control system which controls movement of the ram. The control system includes an emitter which emits a beam of light and a detector assembly which detects an interruption of the light beam. The detector assembly includes two sensors and a beam splitter at which the light is directed. The sensors are connected in series such that if either or both of the sensors detect that the light beam is interrupted, a signal is sent to the drive to open the ram. The press is provided with a reset switch which is closed when the ram is moved to an open position. The reset switch is connected and operable such that the press brake cannot be reset if the light beam is interrupted. The press brake also includes a muting switch which is connected and operable to mute the output of the sensors when the ram is moved from the actuation point toward the bed to bend sheet metal, thereby preventing an interruption of the light beam opening the ram during actual bending of the sheet metal. The emitter and detector assembly can be arranged to provide a single light beam, or two light beams, one in a front plane and one in a back plane of the press brake.

18 Claims, 6 Drawing Sheets

CONTROL SYSTEM FOR A PRESS BRAKE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to press brakes or metal bending machines, and in particular, to a control system for the metal bending machine.

Press brakes or metal bending machines have long been used to form bends, for example, in metal. The metal bending machines have a movable ram and a fixed bed. A punch is fixed to the upper beam (or ram) and a die is fixed to the lower beam (or ram). Typically, press brakes built in the United States are down-acting machines (i.e., the ram moves down). Up-acting machines (the ram moves up) are more typical in Europe, but are also available in the United States.

In a typical press operation, the ram is moved towards the bed to an approach point where the gap between the punch and die is as small as possible, but large enough to insert the material to be bent. The sheet metal (or material to be bent) is then inserted and positioned in the press brake. The press brake is then activated again to bend the sheet metal. Once the sheet metal is bent, the ram is opened and the bent sheet metal is removed from the press brake.

Several different devices have been provided to help reduce the possibility of injury to press brake operators. One system employs a light curtain. In this system, an emitter is positioned on one side of the press brake to pass a beam of light in front of the press brake. A receiver on the opposite side of the press brake receives the beam of light. When the light beam is interrupted, the press brake reverses and opens. This worked well to help reduce injuries to press brake operators. However, often the bending metal would pass in front of the light beam, and block the light beam, causing the press brake to open. One method of avoiding this was to design the control system so that if it detected something that was very thin or narrow, it would interpret this to be the sheet metal, and the safety control system would not be activated. However, in some instances, the sheet metal would bend out of plane (i.e., it would form an angle of other than 90° with the vertical) and would trip the control system, causing the press brake to open, interrupting the bending operation.

To overcome this problem, other systems relied on the fact that once the approach point is reached, an operator's hand or finger could not fit between the punch and die. In these systems, any perceived break in the light beam prior to the brake press reaching its approach point would cause the press brake to open. However, a perceived break in the light beam after the press brake was reactivated to bend the sheet metal would be ignored. This avoided the problem of tripping the control system when the sheet metal bends out of plane.

These systems also worked well. However, none of the systems known compensated for failure in the relays of the control system (such as the relay contacts becoming welded). In these circumstances, the safety control system may become inoperable—either the control system would continuously send a signal to open the press brake, or it would not send a signal when the light beam is interrupted. Additionally, a reliable way to reset the safety control system is required, to help ensure that the brake press is free of obstructions before a bending cycle is started.

BRIEF SUMMARY OF THE INVENTION

A press brake machine has a movable ram, a fixed bed, a drive for moving the ram toward and away from the bed, and a control system which controls movement of the ram. The control system includes an emitter which emits a beam of light and a detector assembly which detects an interruption of the light beam. The detector assembly outputting a first signal when the light beam is detected and a second signal when the light beam is interrupted. In response to the output of the second signal, the drive moves the ram away from the bed to open the press brake.

The emitter and detector can be positioned on opposite (i.e., left and right) sides of the press brake. Alternatively, the emitter and detector can be positioned on the same (e.g., left) side of the press brake, with, for example, the emitter being in a front plane of the press brake and the detector assembly being in a back plane of the press brake. A mirror assembly is positioned on the other (right) side of the press brake and receives the light from the emitter and reflects it back to the detector. This second arrangement provides for front and back light beams which are spaced apart by a distance approximately equal to the width of the die, and will detect something being inserted between the punch and die, whether the obstruction comes from the front or back of the press brake.

The detector assembly includes a first sensor, a second sensor, and a beam splitter. The emitter is aligned with the beam splitter so that the light beam is directed at the beam splitter. The beam splitter and mirrors directs a portion of the light beam to the first sensor and a portion of the light beam to the second sensor. The sensors produce an output in response to the detection of an interruption of the light beam. The first and second sensors each include a relay, the relays having coils movable between a first (energized) state and a second (de-energized) state, and contacts switchable between an open position and a closed position in response to the state of the coils. The coils are switched from the first state to the second state in response to the sensor output produced when an interruption of the light beam is detected. Importantly, the detector assembly's second signal is output when either or both of the sensors detect that the light beam is interrupted. To accomplish this "either/or" condition, the contacts (preferably the normally open contacts) of the first and second relays are connected in series. Thus, the relays, when connected in series, create a redundancy which allows the detector assembly to function properly when the contacts of one of the relays are welded closed.

The beam splitter preferably includes a threaded shaft and a head on the end of the shaft. The head preferably is integral with the shaft and comprises a pair of polished surfaces defining a triangle in cross-section. Because the splitter is on a threaded shaft, the precise position of the splitter can be adjusted to account for variance in the position of the sensors, to better aim the light at the sensors.

The press brake is provided with a reset switch, the contacts of which are movable between an open position and a closed position. The reset switch contacts are closed when the ram is in its opened position. The reset switch is connected in series between the output of one of the sensors and the relay coils. Hence, the reset switch receives its voltage from the sensor. The relay coils are maintained in their first, energized, state when both the switch is closed and when the sensor detects the light beam. If the sensor from which the reset switch receives voltage detects an interruption of the light beam, the relay coils are not energized, and a new bending cycle cannot be started. Once the bending cycle has started, and the ram begins to move towards the actuation point, the reset switch is opened, allowing the coils to be switched between their energized and de-energized states based solely on the output of the sensors.

The press brake is also provided with a muting switch which mutes the output of the sensors when the ram is being moved from the actuation point to the bed to bend sheet material placed in said press brake. The muting switch is in electrical communication with the relay coils and is closed when said ram reaches the actuation point and remains closed while the ram is moved from the actuation point to the bed. When the muting switch is closed, the coils are maintained in their first, energized, state such that the detector assembly outputs only the first signal, regardless of the output of the sensors. Thus, if the light beam should be interrupted, for example by the bending metal, the bending cycle will not be affected.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what I presently believe is the best mode of carrying out the invention.

Figure 1:
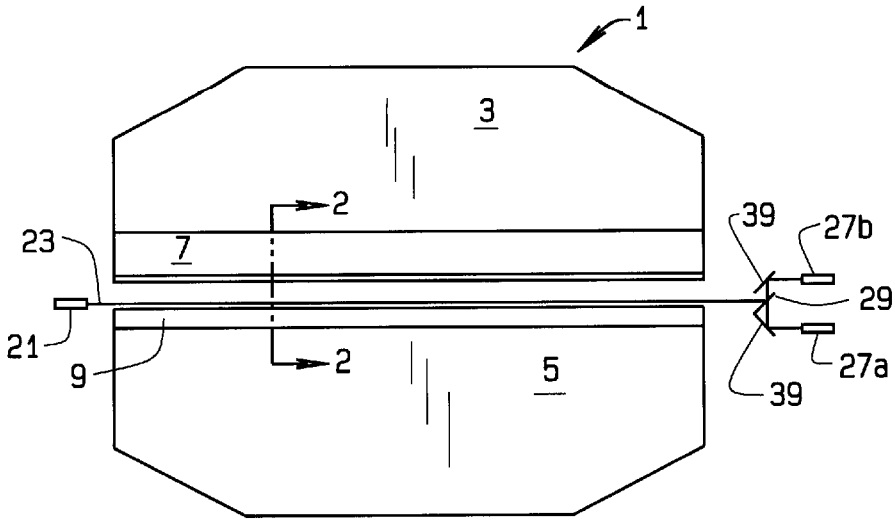
FIG. 1 is a schematic view of a press brake employing a safety control system of the present invention.
Figure 2:
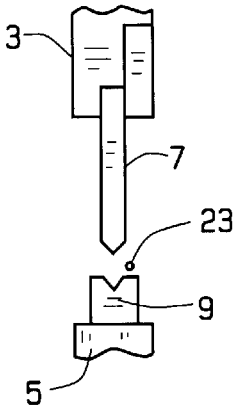
FIG. 2 is a cross-sectional view of the press brake taken along line 2—2 of FIG. 1.

A press brake 1 is shown generally in FIGS. 1 and 2. The press brake 1 includes a fixed bed 3 and a movable ram 5. The ram 5 is preferably beneath the bed 3, and hence must move upwardly to bend metal. A punch 7 is fixed to the bottom edge of the bed 3 and a die 9 is fixed to a top edge of the ram 5. The press brake is an up-acting press brake. However, the press brake 1 could be made with the ram on top, and the bed below to be a down-acting machine. In either event, the ram is hydraulically operated.

Figure 3:
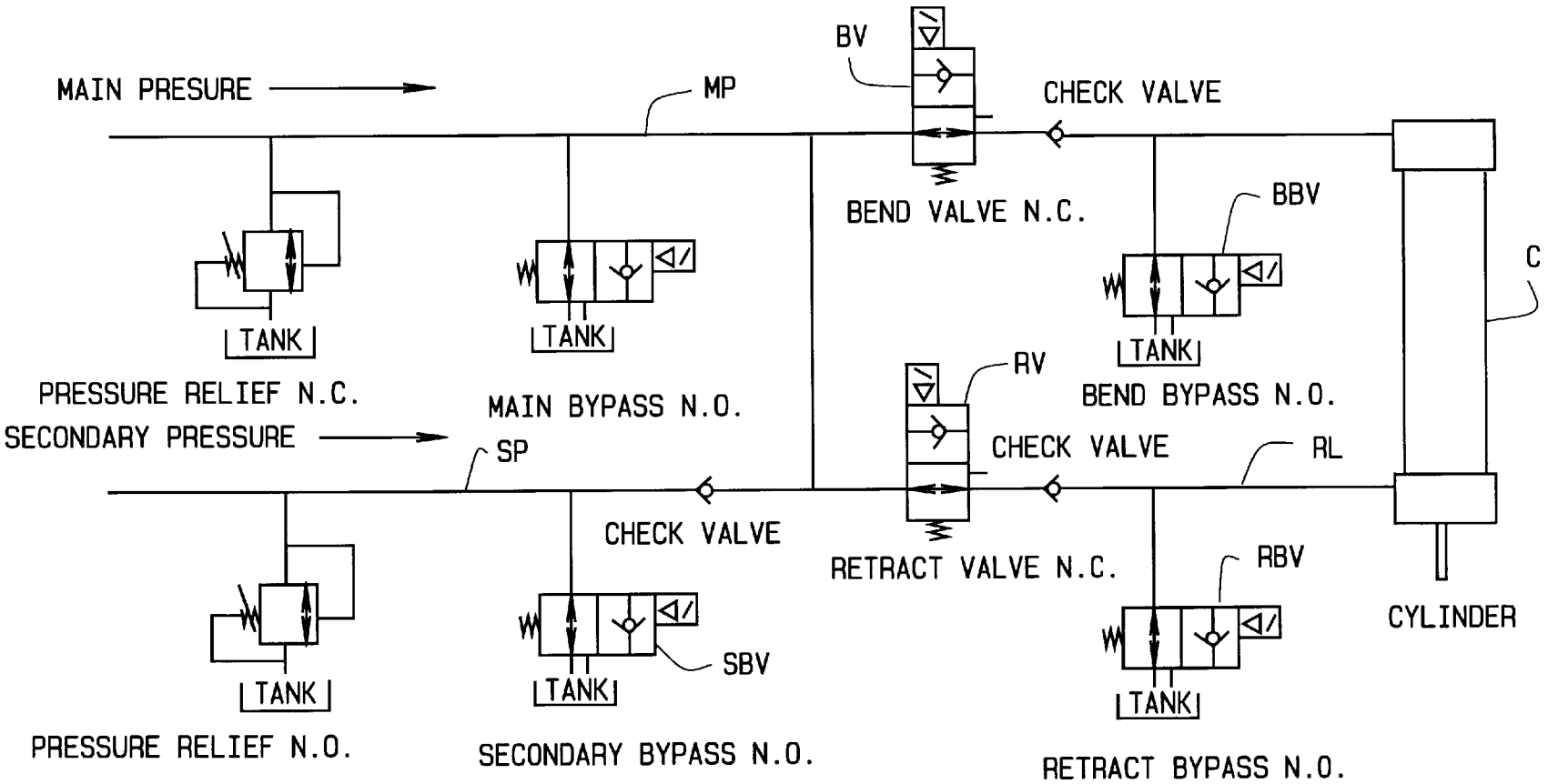
FIG. 3 is a schematic of the hydraulic system which moves the ram.

The preferred hydraulic system is shown in FIG. 3 The hydraulic system includes a cylinder C to which the ram is operatively connected, such that movement of the cylinder's rod will move the ram. The cylinder C is a two port cylinder. Hydraulic fluid is provided to a first port through a main pressure line MP and to the second port through a retract line RL. A secondary pressure line SP also serves the first port to increase the speed at which the cylinder moves. A main bypass valve MBV, bend valve BV, and bend bypass valve BBV are provided in the main pressure line MP; a retract valve RV and retract bypass valve RBV are located in the retract line RL; and a secondary bypass valve SBV is located in the secondary pressure line SP. The bypass valves, when open, allow the fluid in the particular line to drain back to the tank of hydraulic fluid. In operation; when the ram is open, fluid is moved through both the primary and secondary pressure lines MP and SP to supply fluid to the first port to more quickly move the ram to the approach point. As the ram is moved to the approach point, the bend valve BV and retract bypass valve RBV are opened; and the main bypass valve MBV, bend bypass valve BPV and secondary bypass valve SBV are closed. When the ram is moved from the approach point to the bed to bend metal, fluid is continued to be supplied though the first port. However, this time, the fluid is preferably supplied only through the main pressure line MP; and the secondary bypass valve SBV is opened. By using only the main pressure line (as opposed to both the main and secondary pressure lines), the rate of flow of hydraulic fluid is reduced, and the same pump can be used to produce more pressure, to be able to bend thicker sheets of steel. To retract the ram, hydraulic fluid is introduced through the cylinder's second port through the retract line RL. In this instance, the retract valve RV, main bypass valve MBV, bend bypass valve BBV, and secondary bypass valve SBV are opened; and the bend valve BV and retract bypass valve RBV are closed. Thus, the ram is forced open by the hydraulic system.

The use of the secondary pressure lines SP allows for a "two-speed" brake press. The secondary pressure line SP can be used to move the ram more quickly, for example to move the ram to the approach point more quickly, or to speed up the rate at which the brake press cycles (i.e., to bend thin sheet metal more quickly). When the secondary pressure line SP is deactivated (by opening the secondary bypass valve SBV), the flow of fluid to the cylinder will be reduced and the ram will be moved more slowly. However, this allows for more pressure can be applied to the sheet metal, to allow bending of thicker pieces of sheet metal.

The valves are configured such that the bypass valves MBV, BBV, and RBV are normally opened, and the bend valve BV and retract valve RV are normally closed. Thus, under a loss of power, the fluid will be moved through the pressure lines to the by-pass valves and to the tanks under gravity.

A control. system CS (FIG. 1) is provided to open the press brake if, for example, an operator's hand or arm should come between the die and punch prior to the ram reaching the approach point. The control system CS includes an emitter 21 (such as a laser) which produces a beam 23 of coherent light and a receiver or detector assembly 25. The emitter 21 and receiver assembly 25 are mounted to the ram 5 of the press brake 1. on opposite sides of the ram 5. Thus, the control system will move with the ram 5. In a down-acting machine, the emitter and receiver assembly are mounted to the bed. In either event, the emitter and receiver are mounted to the lower of the ram and bed. The emitter 21 is mounted to the ram 5 (or bed in a down-acting machine) such that the laser beam 23 is about ¼" to ½" above the level of the die 9. This width corresponds to the approximate width of a normal operator's hand or finger. Thus, an operator could not place his or her hand or arm between the punch and die without breaking the light beam 23.

Figure 4:
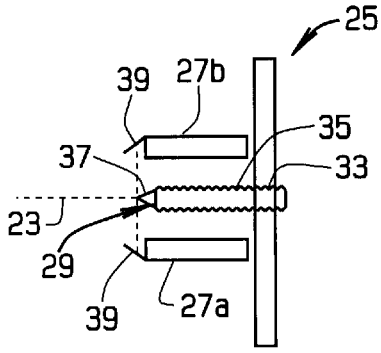
FIG. 4 is a schematic view of a receiver assembly of the safety control system.
Figure 5:
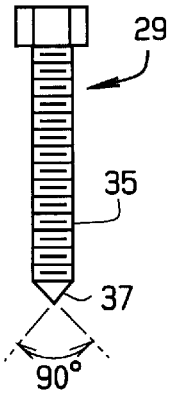
FIGS. 5 and 5A are front and side elevational views of a beam splitter for use with the receiver assembly.
Figure 5A:
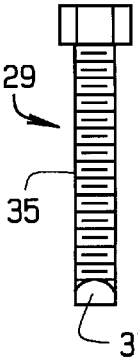

The receiver or detector assembly 25 (shown schematically in FIG. 4) includes a pair of detectors or sensors 27*a,b* and a beam splitter 29. In the embodiment shown in FIG. 4, the detectors 27*a,b* are mounted to a board 31 equidistantly from a screw hole 33. The beam splitter 29 (FIGS. 5, 5A) is made of a threaded bolt 35 having a head 37 polished to a mirror finish. The head 37 forms a triangle having two flat surfaces which define an angle of 90°. The emitter 21 and receiver assembly 25 are mounted such that the beam 23 from the emitter 21 will impinge on the apex of the triangular head 37. The mirrored surface of the head 37 will split the beam 23 such that part of the beam goes one direction (preferably up) and the other portion of the beam goes an opposite direction (preferably down). A pair of mirrors 39 direct the split beam at the detectors 27*a,b*.

Figure 6:
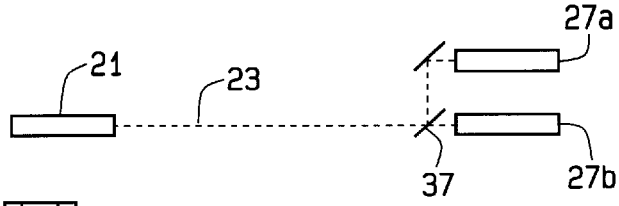
FIG. 6 is a schematic diagram of an alternative light splitter, using a 50% reflective surface.

The use of the polished surface on the end of a threaded bolt allows for the position of the mirrored surface to be adjusted if necessary. This allows for wider variances in the relative lengths of the detectors and the mounting of the detectors on the board 31. The polished surface can be replaced with a prism, which could be mounted on the end of a bolt. Alternatively, as shown in FIG. 6, the emitter could be positioned to be aligned with, for example, the bottom detector 27*b*, and a 50% reflective mirror 37' could be positioned in front of the bottom detector to allow half the light to pass through to the bottom detector and half the light to be deflected to the top detector.

As will be discussed below, the control system CS is configured such that while the ram 5 is being brought to the approach position, if either or both of the detectors determine the light beam 23 has been broken, the press brake will open, and the ram will return to its opened position. Once the ram has reached the approach point, and the press brake is reactivated to bend the metal sheet, an interruption of the light beam will be disregarded, and the press brake will not open if the light beam 23 is interrupted. The distance over which the ram moves while the detector output is muted is ½" to ¼", which is less than the width of a normal hand or finger. Thus, it is unlikely that an operator will be able to insert his or her finger or hand into the space between the punch and die while the ram moves this ½" to ¼" distance to bend the metal between the punch and die.

Figure 7:
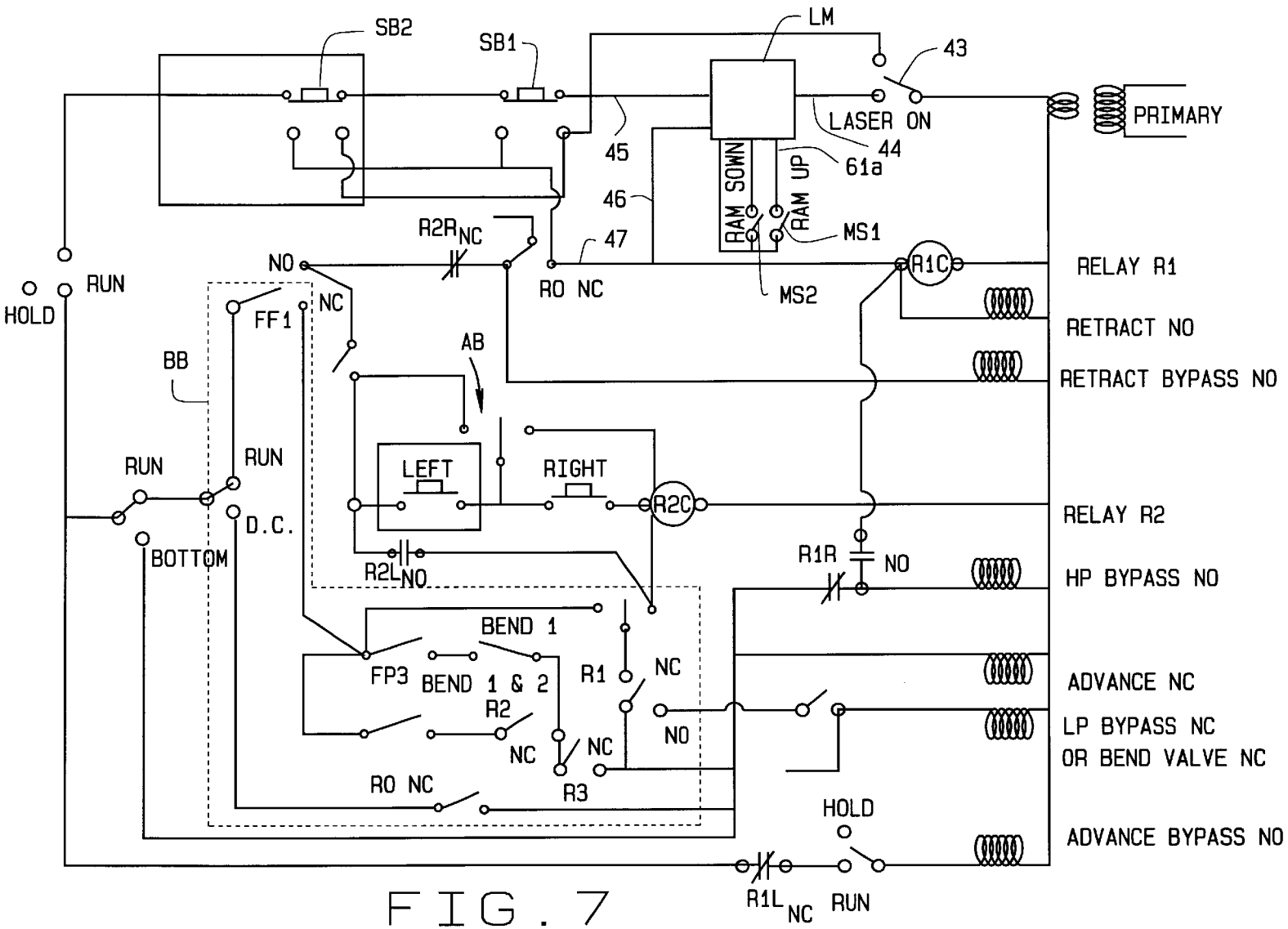
FIG. 7 is an electrical schematic for the press brake.

The circuitry 41 of the brake press 1 is shown in FIG. 7. The brake press circuitry includes a laser module LM and a switch 43 movable between an on and off position, and which provides power to the laser module LM. The switch 43 is connected to an input line 44 of the laser module LM. The laser module LM includes the emitter 21 and detectors 27*a,b* and associated relays, which as discussed below, will cause the ram to open when the light beam 23 is interrupted during the approach. The brake press circuitry 41 also includes a pair of emergency stop buttons SB1 and SB2 which are positioned on opposite sides of the brake press frame, an approach button assembly AB, a bending button BB, and a pair of relays R1 and R2. The approach button AB and bending button BB can be provided as panel buttons, foot levers, etc. The relays R1 and R2 are double pole, double throw switches. The right contacts of the relays are shown in FIG. 7 as R1R and R2R, and the left contacts are shown as R1L and R2L. The subscripts "NO" and "NC" are provided to designate a normally open or normally closed contact. The relays R1 and R2 are operated by the switches SB1, SB2, AB, and BB, and the laser module LM to open and close the valves of the hydraulic system to move the ram toward and away from the bed. When either stop buttons SB1 or SB2 is depressed, the relays R1 and R2 are moved to a state to open the retract valve RV, bend bypass valve BPV, main bypass valve MPV, and secondary bypass valve SBV, and close the bend valve BV and retract bypass valve RBV, so that the hydraulic fluid will enter the cylinder through the second port to force the ram opened. The approach switch AB switches the relays R1 and R2 to a state to configure the valves, as described above, to apply fluid through both the primary and secondary pressure lines to bring the ram from the open position to the approach point. Lastly, the bend button switch BB moves the relays R1 and R2 to a state to configure the valves as described above to apply fluid through the main pressure line MP to move the ram from the approach point to the bed to bend the material between the punch and die.

The laser module LM is wired in series with the emergency stop buttons and includes a first output line 45 which is connected to a contact of the stop button SB1 and a second output line 46 which is connected to the relay R1. When the light beam 23 is interrupted, the laser module sends a signal through line 45 to switch the relays R1 and R2 to the same state as with the stop buttons, to cause the ram 5 to open. Thus, the press brake circuitry 41 treats a signal over the second output line 46 from the laser module LM in the same manner in which it treats a signal from the emergency stop buttons SB1 and SB2.

A pair of normally opened micro-switches MS1 and MS2 are also associated with the laser module LM. Micro-switch MS1 is closed by the ram when the ram is up (i.e., when the ram is at the approach point). Micro-switch MS2 is closed by the ram when the ram is down (i.e., the press brake is opened and ready to begin a new cycle). As discussed above, after the ram reaches the approach point, the sheet metal is placed in the press brake to be bent; and the ram is reactivated, any break in the laser beam 23 is disregarded. Micro-switch MS1 is the muting switch, and, as discussed below, when closed, the micro-switch MS1 prevents the laser module LM from outputting a signal when the light beam 23 is interrupted-which would activate the relays R1 and R2 to open the ram. After a cycle is completed, and the ram returns to its down position, the ram closes micro-switch MS2 and muting switch MS1 opens. Micro-switch MS2 is a reset switch. As discussed below, switch MS2 will not reset the press brake if the light beam 23 is interrupted.

Figure 8:
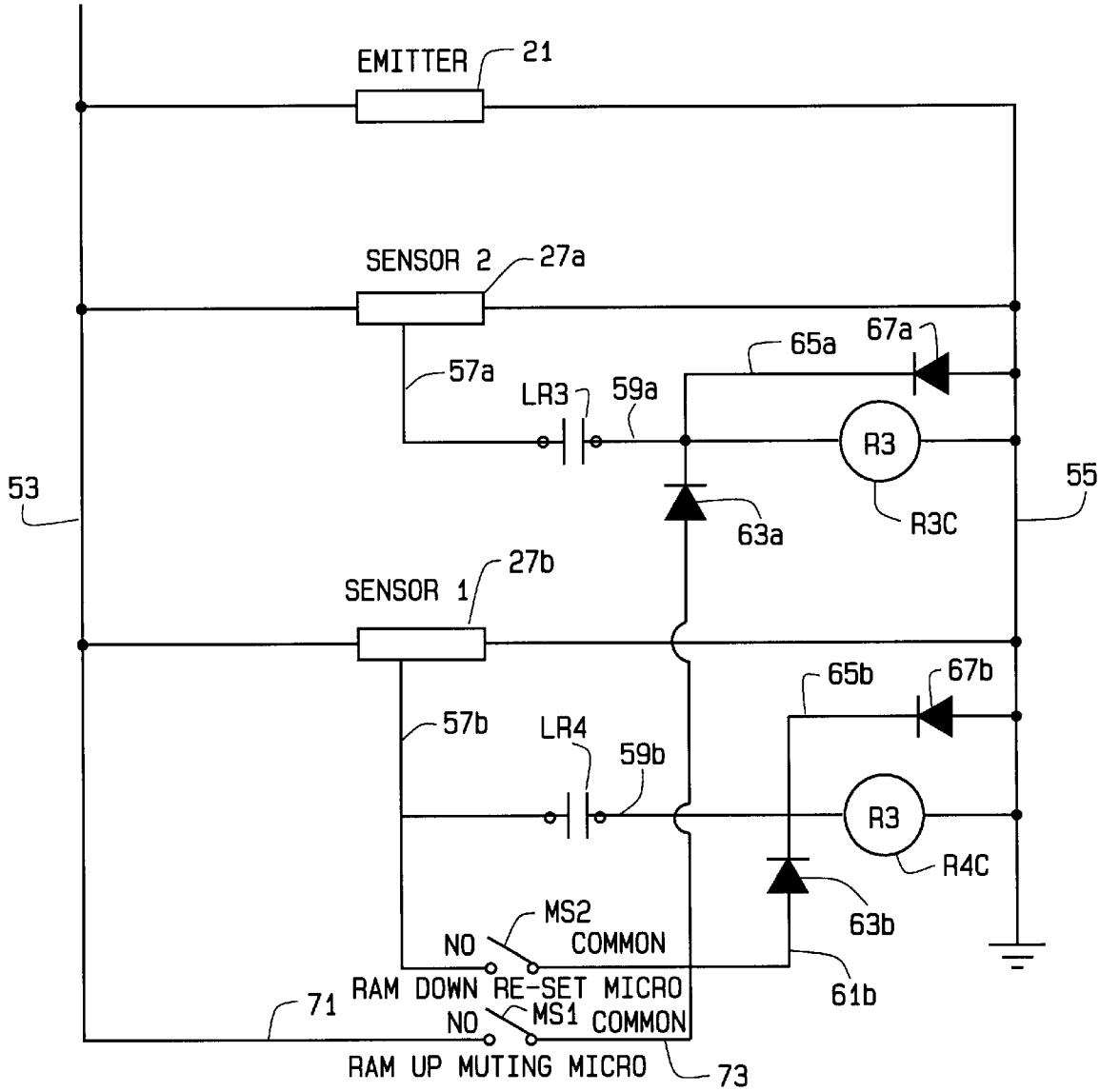
FIG. 8 is an electrical schematic of the DC circuit for the control system.
Figure 9:
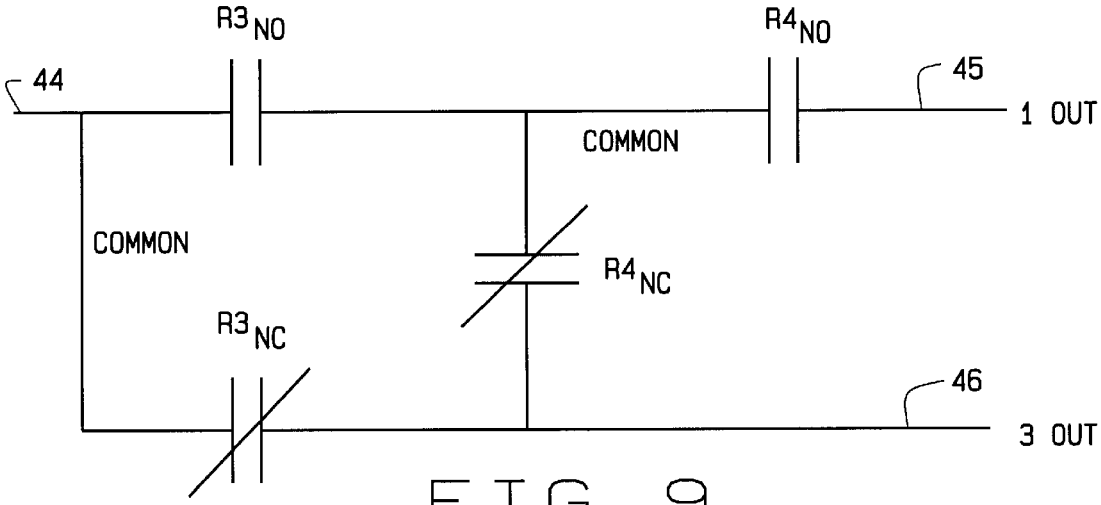
FIG. 9 is an electrical schematic of the AC circuit for the control system.
Figure 10:
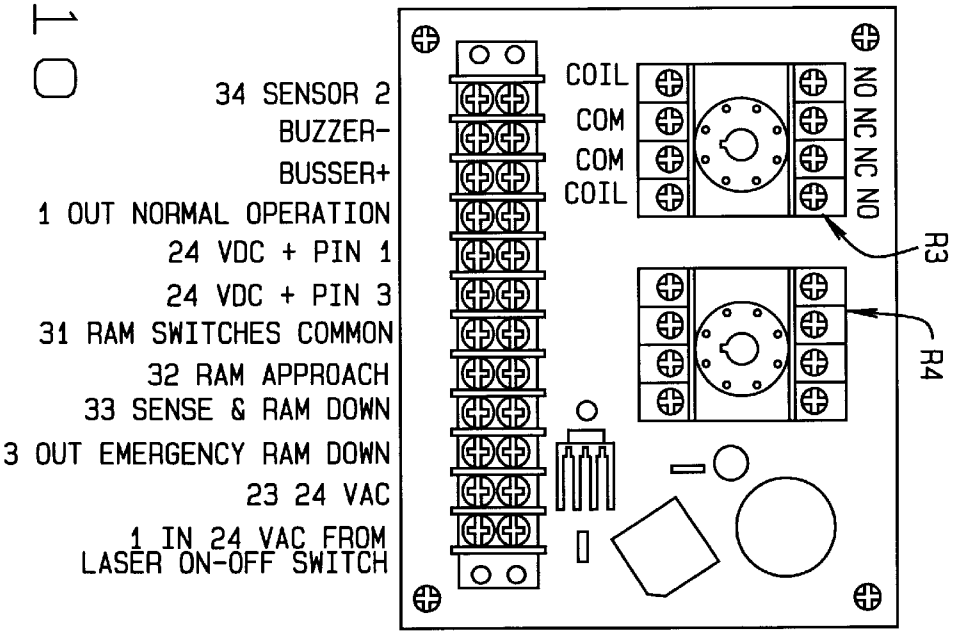
FIG. 10 is a plan view of the laser module control board in which the circuits of FIGS. 8 and 9 are incorporated.
Figure 11:
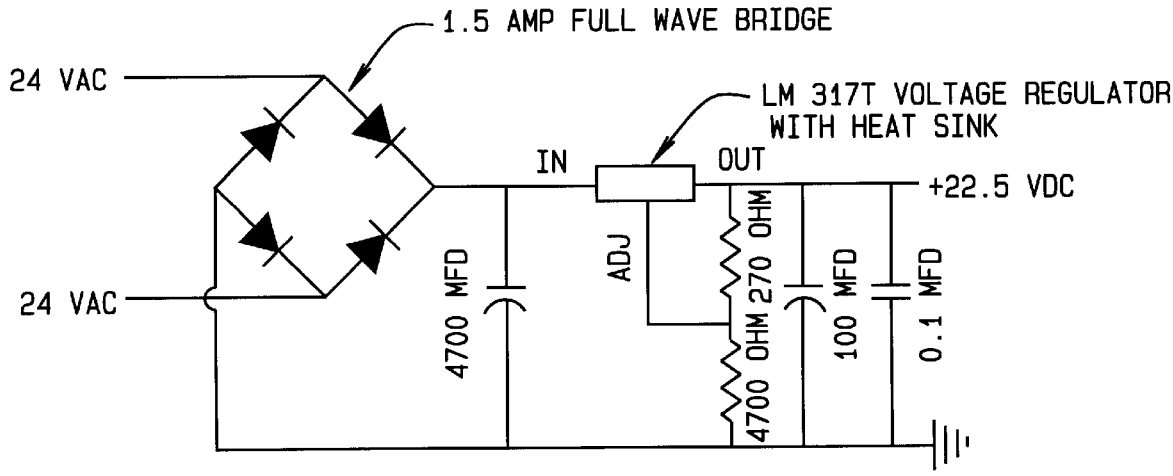
FIG. 11 is an electrical schematic of a power supply for use with the control system.

The circuitry of the laser module LM is shown in FIGS. 8 and 9. The laser module includes a pair of relays R3 and R4 which send a signal out over the laser module output line 46 when the light beam is interrupted. The relays R3 and R4 are double pole, double throw relays and have a DC component and an AC component. The DC circuit (FIG. 8) provides actuating current to the relay's coils, and the AC circuit (FIG. 9) provides the current to the contacts which are connected to the output lines 45 and 46.

The DC circuit 51 (FIG. 8) is a 24 VDC circuit and includes a common wire 53 and a ground wire 55. The detectors 27*a,b* are similarly connected between the common and ground wires 53 and 55. Hence, the relay coils are connected in parallel in the DC circuit. Each detector has an output line 57*a,b* which is connected to contacts LR3 and LR4 of relays R3 and R4, respectively. The contacts LR3 and LR4, in turn, are connected to relays coils R3C and R4C over lines 59*a,b*. The coils, in turn, are connected to the ground wire 55.

The output wire 57*b* of detector 27*b* is also connected to one of the contacts of the reset switch MS2. The opposite contact of the reset switch is connected to lines 59*a,b* over lines 61*a,b* to be in electrical communication with relay coils R3C and R4C. The, voltage for the reset switch MS2 comes from the sensor 27*b*. Therefore, if sensor 27*b* determines that the light is blocked, current will not pass to the coils R3C or R4C even if the switch MS2 is closed. Diodes 63*a,b* are placed in lines 61*a,b* prior to the intersection of lines 61*a,b* with lines 59*a,b,* respectively. Lines 65*a,b* extend from the junction of lines 61*a,b* and 59*a,b* to the ground wire 55. Diodes 65*a,b* are positioned in lines 65*a,b,* respectively.

Lastly, the muting switch MS1 is connected to the common wire 53 by a wire 71 and is connected to wires 61*a,b* by a wire 73 to be in electrical communication with the relay coils R3C and R4C.

The diodes 63*a,b* are positioned to allow current to flow to either the coils R3C and R4C, or the contacts LR3 and LR4. The diodes 67*a,b* are positioned to prevent DC current from flowing from the junction of wires 61*a,b* and 59*a,b* to the ground. Thus, all current, whether it is passes through the switch MS1 or the detector outputs 57*a,b* is directed to the ground wire 55 through the relay coils R3C and R4C.

When the ram has reached the approach point, and the press brake is bending the sheet metal, the muting switch MS1 is closed. Thus, the current will pass through the muting switch MS1, by-passing the detectors 27*a,b,* to continuously energize the coils R3C and R4C while the switch is closed. When the ram is down (i.e., the press brake is opened), the muting switch MS1 will open and the re-set switch MS2 will close. Again, in this state, the coils R3C and R4C will be continuously energized (as long as contact LR4 is closed). However, when the ram begins to move from the down position to the approach point, both switches MS1 and MS2 are opened, and all current passes through the contacts LR3 and LR4. As long as the detectors 27*a,b* "see" the light beam 23, the contacts LR3 and LR4 are closed, and the coils are energized. When the light beam 23 is interrupted, the contacts LR3 and LR4 open, and the coil is de-energized. As discussed below, as long as the coil is energized, no signal is sent out over the second output line 46. However, when the coil is de-energized, a signal is sent out over the output line 46 to activate the relays R1 and R2, to open the ram.

The AC wiring of the relays R3 and R4 is shown in FIG. 9. The normally open and normally closed contacts of R3 and R4 are indicated by $R3_{NO}$, $R3_{NC}$, $R4_{NO}$, and $R4_{NC}$. As seen in FIG. 9, the normally open contacts $R3_{NO}$ and $R4_{NO}$ of the relays R3 and R4 are connected in series between the input wire 44 and the output wire 45 of the laser module LM. The normally closed contact $R3_{NC}$ of relay R3 connected between the laser module input wire 44 and the output wire 46. The connection of the normally closed contact $R3_{NC}$ with the input wire is prior to the normally open contact $R3_{NO}$ of relay R3. Thus, the normally open and normally closed contacts $R3_{NO}$ and $R3_{NC}$ of relay R3 are connected in parallel in the AC circuit. Therefore, all the current is directed to the two contacts $R3_{NO}$ and $R3_{NC}$ of relay R3. The normally closed contact $R4_{NO}$ of relay R4 is connected on one side to the laser module output wire 46 and connected on the other side to the wire extending between the normally open contacts $R3_{NO}$ and $R4_{NO}$ of relays R3 and R4, respectively.

When the coils R3C and R4C are energized, the normally open contacts $R3_{NO}$ and $R4_{NO}$ are closed and the normally closed contacts $R3_{NC}$ and $R4_{NC}$ are opened, and current passes to the normal or first laser module output line 45. Conversely, when the coils are de-energized, the normally open contacts $R3_{NO}$ and $R4_{NO}$ are opened and the normally closed contacts $R3_{NC}$ and $R4_{NC}$ are closed, and current passes to the second laser module output line 46. When current is passed through output line 46, the relays R1 and R2 are activated to open the ram.

During the approach of the ram, when the detectors 27*a,b* are receiving the light beam 23 (i.e., when the light beam is not blocked), the relay contacts LR3 and LR4 (FIG. 6) are closed, and the coils R3C and R4C are energized. Therefore, the normally open contacts of relays R3 and R4 are closed, and the normally closed contacts of relays R3 and R4 are opened. Thus, the current will pass to the output wire 45, indicating that no fault is detected. When the light beam 23 is interrupted, the relay contacts LR3 and LR4 will open, de-energizing the coils R3C and R4C. The normally closed contacts $R3_{NC}$ and $R4_{NC}$ will close and the normally open contacts $R3_{NO}$ and $R4_{NO}$ will open. Therefore, the current will be directed to the output wire 46 to energize relays R1 and R2 (FIG. 7), to signal a fault and to open the press brake.

As noted above, the normally open contacts $R3_{NO}$ and $R4_{NO}$ are connected in series. Thus, if either of the normally open contacts should fail (i.e., become welded closed), as long as the other relay is still functioning, the control system CS will be operational. For example, if the normally open contact $R3_{NO}$ should be welded closed, current will pass to the normally open and normally closed contacts of relay R4. As long as relay R4 is functioning, it will send a signal to relay R1 over laser module output line 46 when the light beam 23 is interrupted. Similarly, if the normally open contact of relay R4 is welded closed, or otherwise not functioning, as long as the relay R3 is operational, relay R3 will send a signal to the relays R1 and R2 when the light beam is interrupted to open the ram. Thus, the series connection of the contacts of relays R3 and R4 create a redundancy which will allow the press brake to operate if one of the relays becomes non-functional. Because the normally closed contacts $R3_{NC}$ and $R4_{NC}$ are connected to the output line 46, if both relays become non-functional, a signal will be sent out over the output line 46, and the relays R1 and R2 will be activated to open the press brake.

In operation, when the ram is down (i.e., the press brake is opened), the reset switch MS2 is closed to energize the coils R3C and R4C, and the contacts $R3_{NO}$ and $R4_{NO}$ are closed and contacts $R3_{NC}$ and $R4_{NC}$ are opened. As noted above, the voltage for the reset switch MS2 comes from the sensor 27*b*. Thus, if the light beam is interrupted, and the sensor 27*b* determines that something is in the brake press, voltage will not pass through to the switch MS2 and the coils R3C and R4C. The coils will not be activated, the brake press will not be reset, and hence a new cycle cannot begin until the blockage is removed from the brake press and the sensor 27*b* detects the light beam 23. When the cycle is started and the ram is moved towards the approach point, the switches MS1 and MS2 are both opened, so that all current to the coils is directed through the contacts LR3 and LR4. Thus, if a light beam interruption is sensed by the detectors 27*a* and/or 27*b,* an appropriate signal will be sent out over output line 46, as described above, to open the ram. When the ram reaches the approach point, the muting switch MS1 is closed to provide continuous current to coils R3C and R4C; the contacts $R3_{NO}$ and $R4_{NO}$ are closed and contacts $R3_{NC}$ and $R4_{NC}$ are opened. Thus, as the ram moves from the approach point to bend a sheet of metal positioned between the die and punch, even if the detectors 27*a,b* should detect an interruption in the light beam 23, no signal will be sent out over the output line 46, and hence, the bending of the sheet metal will not be interrupted. After the sheet metal is bent, the ram is returned to its down position (i.e. the press brake is opened) to start another cycle. In this position the ram down or reset switch MS2 is closed and the muting switch MS1 is opened. As noted above, because the reset switch MS2 obtains its voltage from the sensor, a new cycle cannot be started unless the brake press is free from obstructions. Thus, if an operator's hand or arm, for example, were between the press's ram and bed, a new cycle could not be started.

Figure 12:
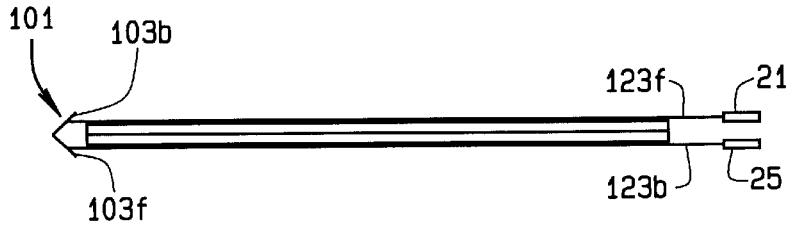
FIG. 12 is a schematic view of an alternative set up for the emitter and receiver assembly to provide a light curtain on both the front and back of the press brake.
Figure 13:
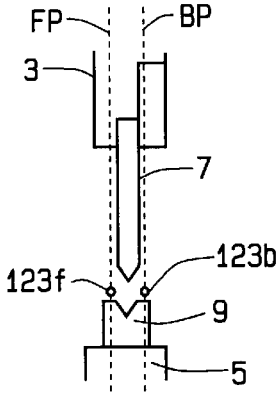
FIG. 13 is a vertical cross-sectional view taken through the press brake showing the location of the front and back light beams produced by the alternative of set up of FIG. 12.

In FIGS. 1 and 2, the emitter 21 and detector assembly 25 are on opposite (left and right) sides of the press brake. As such, a light curtain is formed on only one side (the front side) of the press brake, as seen in FIG. 2. In FIGS. 12 and 13, an alternate setup is shown in which the same emitter and detector assembly are arranged to form a light curtain or light beam on both the front and back of the press brake using a single emitter 21 and a single detector assembly 25. In this setup, the emitter 21 and detector assembly 25 are provided on the same side (e.g., right side) of the press brake, with, for example, the emitter 21 being positioned in a front plane FP of the press brake and the detector assembly 25 being positioned in a black plane FP of the press brake. A mirror assembly 101 made of a pair of mirrors 103*f* and 103*b* is positioned on the other side (e.g., left side) of the press brake. The emitter directs a light beam at the front mirror 103*f*, and the light is reflected to the back mirror 103*b* which reflects the light beam back to the detector assembly 25. The mirrors 103*f,b* are preferably positioned at 45° with respect to front and back vertical planes of the press brake, and are angled are 90° with respect to each other. The points where the light beam impinges on the mirrors 103*f,b* are preferably spaced apart by a distance equal to the distance between the front and back vertical planes of the press brake, a distance approximately equal to the width of the die, as seen in FIG. 13. As can also be seen in FIG. 13, this arrangement forms a front light beam 123*f* in the front plane FP and a back light beam 123*b* in the back plane BP of the press brake. On the other hand, the single light beam 23 (FIG. 1) is only in the front of the press brake. The construction of the mirror assembly 101 is such that the front and back light beams are generally parallel to each other.

As noted above, this alternative arrangement uses the emitter 21 and reflector assembly 25 as described above. Thus, the operation of the press brake, using this alternative set up will be identical to that described above. However, because this alternative set up provides a light beam both in front of, and in back of, the punch and die, an obstruction which is inserted between the punch and die while the ram is being moved to the approach point will be detected whether the obstruction is introduced from the front or back of the press brake. In the configuration of FIG. 1, an obstruction introduced from the back of the press brake would have to extend fully through the space between the punch and die to be "seen" by the control system.

As various changes could be made in the above constructions without departing from the scope of the invention, it is intended that all matter contained in the above description or shown in the accompanying drawings shall be interpreted as illustrative and not in a limiting sense. Although the control system was described with respect to an up-acting press brake, it can be applied to a down-acting press brake. Although the detectors 27*a,b* are described to be on opposite sides of the beam splitter 29, they need not be spaced apart 180°, nor do they need to be equidistant from the beam splitter. Rather than using a beam splitter, the control system could be provided with an emitter which produces a wide beam of light. This wide beam of light would then impinge upon both of the detectors, avoiding the need for a beam splitter. If either or both of the detectors sensed an interruption in the beam, a signal would be sent out over the line 46 to cause the press brake to open. These variations are illustrative only.

What is claimed is:

1. A press brake machine having a movable ram, a fixed bed, a drive for moving the ram toward and away from the bed, and a control system which controls movement of the ram; the control system including an emitter which emits a beam of light; and a detector assembly which detects the light beam, the detector assembly outputting a first signal when said light beam is detected and a second signal when said light beam is interrupted; said drive moving said ram away from said bed in response to said second signal;

the detector assembly comprising a first sensor, a second sensor, and a beam splitter; the emitter being aligned with the beam splitter so that the light beam is directed at the beam splitter; the beam splitter directing a portion of the light beam to the first sensor and a portion of the light beam to the second sensor;

said first sensor including a first relay and said second sensor including a second relay; said first and second sensors outputting signals in response to the detection of an interruption of said light beam; said first and second relays each having a coil; said coils being switchable in response to said sensor output between a first coil state and a second coil state to open and close contacts of said relays; said coils being switched to said first coil state when said sensors detect said light beam and said coils being switched to said second coil state when said sensors detect that said light beam is interrupted;

said detector assembly outputting said second signal when either or both of said sensors detect that said light beam is interrupted.

2. The press brake of claim 1 wherein contacts of said relays are connected in series.

3. The press brake of claim 1 including a reset switch in electrical communication with said relay coils; said reset switch being closed when said ram is moved away from said bed to be at the start of a stroke; said reset switch placing said coils in said first coil state when said ram is at the beginning of said stroke.

4. The press brake of claim 3 wherein said reset switch receives voltage from one of said sensors; whereby the a new bending cycle cannot be started if the light beam is interrupted.

5. The press brake of claim 3 wherein said reset switch is opened when said ram begins to move toward said approach point to allow said relays to switch said coils between said first and second coils states in response to the detection of said light beam.

6. The press brake of claim 1 including a muting switch in electrical communication with said relay coils; said muting switch being closed when said ram reaches an approach point and remaining closed while said ram moves from said approach point to said bed to bend sheet material placed in said press brake; said muting switch when closed being operative to maintain said relay coils in said first coil state regardless of the output of said sensors.

7. The press brake of claim 1 wherein one of the emitter and detector assembly is positioned on a right side of the press brake and the other of the emitter and detector assembly is positioned on the left side of the press brake.

8. The press brake of claim 1 wherein the emitter and detector assembly are both placed on the same side of the press brake, the emitter being placed in a first vertical plane of the press brake and the detector being placed in a second vertical plane of the press brake; one of the first and second vertical planes being a front plane, and the other of the first and second vertical planes being a back plane; the press brake including a reflecting assembly on an opposite side of the press brake to reflect light emitted from the emitter to the detector assembly to form a light beam in both the front and back planes of the press brake using a single emitter and a single detector assembly.

9. A control system for a press brake, the control system causing the press brake to open if a foreign object is detected between a ram and a bed of the press brake; the control system comprising:

an emitter which emits a beam of light;

a detector assembly which receives said beam of light; said detector assembly including a first sensor and a second sensor; said first and second sensors including contacts; said contacts of said first and second sensors being connected in series;

said detector assembly producing a first output signal when both said sensors detect said light beam and a second output signal when either or both of said sensors detect that said light beam has been interrupted; said ram being opened in response to said detector assembly second signal.

10. The control system of claim 9 including a beam splitter; said light beam being directed to said beam splitter; said beam splitter directing a first portion of said light beam to said first sensor and a second portion of said light beam to said second sensor.

11. The control system of claim 10 wherein said beam splitter includes a threaded shaft and a head on said shaft said head directing said light to said sensors.

12. The control system of claim 11 wherein said beam splitter head comprises a pair of polished surfaces; said head defining a triangle in cross-section, said polished surfaces directing said light beam to said sensors.

13. A press brake machine comprising:

a movable ram, a fixed bed, and a drive for moving the ram toward and away from the bed, the ram being moved by the drive toward the bed to bend a sheet of material placed between the ram and the bed;

a control system for controlling the movement of the ram, the control system including an emitter and a detector assembly; the emitter emitting a light beam which is detected by the detector assembly; the detector assembly outputting a first signal when said light beam is detected and a second signal when the light beam is interrupted; the drive moving the ram away from the bed in response to the second signal; and a reset switch in electrical communication with said control system; said reset switch being closed when said ram is opened; said reset switch receiving voltage from said detector assembly; said detector assembly being operable such that no voltage is applied to said reset switch when an interruption of said light beam is detected by said detection assembly; whereby, a new bending cycle cannot be initiated and said press brake cannot be reset, if the light beam is interrupted.

14. The press brake of claim 13 wherein said detector assembly includes a sensor which detects the presence or absence of said light beam and a relay; said relay having a coil switchable between a first coil state and a second coil state; said sensor outputting a signal in response to the detection of an interruption of said light beam to switch said coil from said first coil state to said second coil state; said reset switch being connected in series between said sensor output and said relay coil; said reset switch maintaining said coil in said first coil state as long as said sensor detects the presence of said light beam.

15. The press brake of claim 14 wherein said reset switch is opened when said ram is moved toward an approach point to allow said relays to switch said coils between said first and second coils states in response to the detection of said light beam.

16. A press brake machine having a movable ram, a fixed bed, a drive for moving the ram toward and away from the bed, and a control system which controls movement of the ram;

the control system including an emitter which emits a beam of light, a detector assembly which detects the presence of said light beam or an interruption of said light beam, and a reset switch which is activated when said ram is in an opened position;

the detector assembly outputting a first signal when said light beam is detected and a second signal when said light beam is interrupted; said drive moving said ram away from said bed in response to said second signal;

the detector assembly comprising a first sensor, a second sensor, and a beam splitter; the emitter being aligned with the beam splitter so that the light beam is directed at the beam splitter; the beam splitter directing a portion of the light beam to the first sensor and a portion of the light beam to the second sensor;

said first sensor including a first relay and said second sensor including a second relay; said first and second sensors including contacts movable between an open and closed position in response to output from said sensors; said contacts being connected in series; said first and second sensors outputting signals in response to the detection of an interruption of said light beam; said first and second relays each having a coil; said coils being switchable in response to said sensor output between a first coil state and a second coil state to open and close contacts of said relays; said coils being switched to said first coil state when said sensors detect said light beam and said coils being switched to said second coil state when said sensors detect that said light beam is interrupted;

said detector assembly outputting said second signal when either or both of said sensors detect that said light beam is interrupted.

said reset switch being connected in series between the output of one of said sensors and said relay coils; said reset switch being closed when said ram is in said opened position; said reset switch maintaining said coils in said first coil state while said at least one sensor detects said light beam.

17. The press brake of claim 16 wherein the emitter and detector assembly are both placed on the same side of the press brake, the emitter being placed in a first vertical plane of the press brake and the detector being placed in a second vertical plane of the press brake; one of the first and second vertical planes being a front plane, and the other of the first and second vertical planes being a back plane; the press brake including a reflecting assembly on an opposite side of the press brake to reflect light emitted from the emitter to the detector assembly to form a light beam in both the front and back planes of the press brake.

18. A press brake machine comprising:

a movable ram, a fixed bed, and a drive for moving the ram toward and away from the bed, the ram being moved by the drive toward the bed to bend a sheet of material placed between the ram and the bed;

a control system for controlling the movement of the ram, the control system including an emitter and a detector assembly; the emitter and detector assembly both being placed on one of a left and right side of the press brake; the emitter being in one of a front and back vertical plane of the press brake and the detector assembly being in the other of the front and back vertical planes; and a reflective assembly positioned on the other of the left and right side of the press brake; the reflective assembly reflecting a light beam from the emitter to the detector assembly and forming a front light beam and a back light beam;

the detector assembly outputting a first signal when said light beam is detected and a second signal when the light beam is interrupted; the drive moving the ram away from the bed in response to the second signal.

* * * * *